US008007248B2

(12) United States Patent
Pryor et al.

(10) Patent No.: US 8,007,248 B2
(45) Date of Patent: Aug. 30, 2011

(54) ENGINE SPEED DEPENDENT OIL PUMP PRESSURE REGULATION

(75) Inventors: Bryan K. Pryor, Farmington, MI (US); David R. Staley, Flushing, MI (US); Karl R. Gilgenbach, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 652 days.

(21) Appl. No.: 12/174,108

(22) Filed: Jul. 16, 2008

(65) Prior Publication Data

US 2010/0014991 A1 Jan. 21, 2010

(51) Int. Cl.

| | |
|---|---|
| ***F04B 49/00*** | (2006.01) |
| ***F01C 20/18*** | (2006.01) |
| ***F01M 1/04*** | (2006.01) |
| ***F16N 27/00*** | (2006.01) |
| ***F16N 13/20*** | (2006.01) |
| ***F03C 2/00*** | (2006.01) |
| ***F03C 4/00*** | (2006.01) |
| ***F04C 2/00*** | (2006.01) |
| ***F04C 14/18*** | (2006.01) |
| ***F04C 28/18*** | (2006.01) |

(52) U.S. Cl. ..... 417/220; 184/7.4; 184/35; 123/196 CP; 418/30

(58) Field of Classification Search ..... 417/219, 417/220; 418/30; 123/196 R, 196 CP, 198 C, 123/572; 184/11.1, 11.4, 1.5, 6.26, 6.5, 6.8, 184/26, 27.1, 29, 31, 35, 7.4
See application file for complete search history.

(56) References Cited

U.S. PATENT DOCUMENTS

| | | | | |
|---|---|---|---|---|
| 4,583,423 | A * | 4/1986 | Hahne | 475/136 |
| 4,872,377 | A * | 10/1989 | Nakamura | 477/46 |
| 6,763,797 | B1 * | 7/2004 | Staley et al. | 123/196 R |
| 6,848,528 | B2 * | 2/2005 | Pichler et al. | 180/190 |
| 7,134,418 | B2 * | 11/2006 | Nagel et al. | 123/196 R |
| 7,862,306 | B2 * | 1/2011 | Staley et al. | 417/220 |
| 2009/0283067 | A1 * | 11/2009 | Kurihara et al. | 123/196 A |

* cited by examiner

*Primary Examiner* — Devon C Kramer
*Assistant Examiner* — Thomas Fink

(57) ABSTRACT

In an exemplary embodiment, the momentum of oil-containing air rotating with a crankshaft counterweight in an engine crankcase is converted to static pressure by blocking the flow and directing the resulting static pressure through an orifice to a vent chamber wherein the pressure acts against a cam ring of a variable displacement oil pump. The arrangement modifies the action of an oil pressure control by increasing the effective pump outlet pressure as a function of engine speed using relatively low cost modifications of the engine and oil pump. This pressure may also be used in various ways to modify the control functions of other devices.

13 Claims, 3 Drawing Sheets

ENGINE SPEED DEPENDENT OIL PUMP PRESSURE REGULATION

TECHNICAL FIELD

This invention relates to engine oil pump pressure regulation and particularly to variation of oil pump outlet pressure as a function of engine speed.

BACKGROUND OF THE INVENTION

It is known in the art relating to engine oil pumps to vary the pump displacement as a function of pump outlet pressure in order to maintain a constant oil outlet pressure as the speed of the engine driving the pump is varied. This mode of control increases engine efficiency with a positive displacement pump by reducing the volume of oil pumped at higher engine speeds with a resultant saving of energy. However, with the varying demands being made to provide smaller but more powerful engines having increased fuel economy, consideration was given to modifying the pressure oil control system to allow some increase in controlled oil pressure as a function of increased engine speed. A simplified system for providing such an improvement was desired.

SUMMARY OF THE INVENTION

The present invention takes advantage of the energy present in air and other fluids that are placed in motion through their continuing presence near rotating components of an engine, such as the crankshaft, balance shafts, camshafts, transmission shafts and the like. For example, the rotation of a crankshaft in an engine crankcase creates a substantial amount of motion in the fluid and entrained oil droplets that are stirred up by the movement of the crank throws, connecting rods and counterweights through the oil containing fluid. The energy present in this moving fluid is utilized in the invention by convening the momentum of a captured portion of the moving fluid to a static pressure that is a function of the engine speed. This pressure may also be used in various ways to modify the control functions of other devices.

In a specific embodiment, the invention uses the static pressure in fluid as an actuating force in an oil pump displacement control. The static pressure is applied directly to a chamber within the pump to modify the pressure control based upon the oil pump outlet oil pressure, which reduces the pump displacement to maintain a pressure control function. The addition of the static pressure, collected from the momentum of fluid rotating with the outer surface of a crankshaft counterweight, modifies the effect of the oil pressure control, causing the oil pressure to be increased as a function of the engine speed and resulting in an increase in the lubrication provided to the engine as engine speeds are increased.

These and other features and advantages of the invention may be more fully understood from the following description of an exemplary embodiment, taken together with the accompanying drawings.

DESCRIPTION OF AN EXEMPLARY EMBODIMENT

Figure 1:
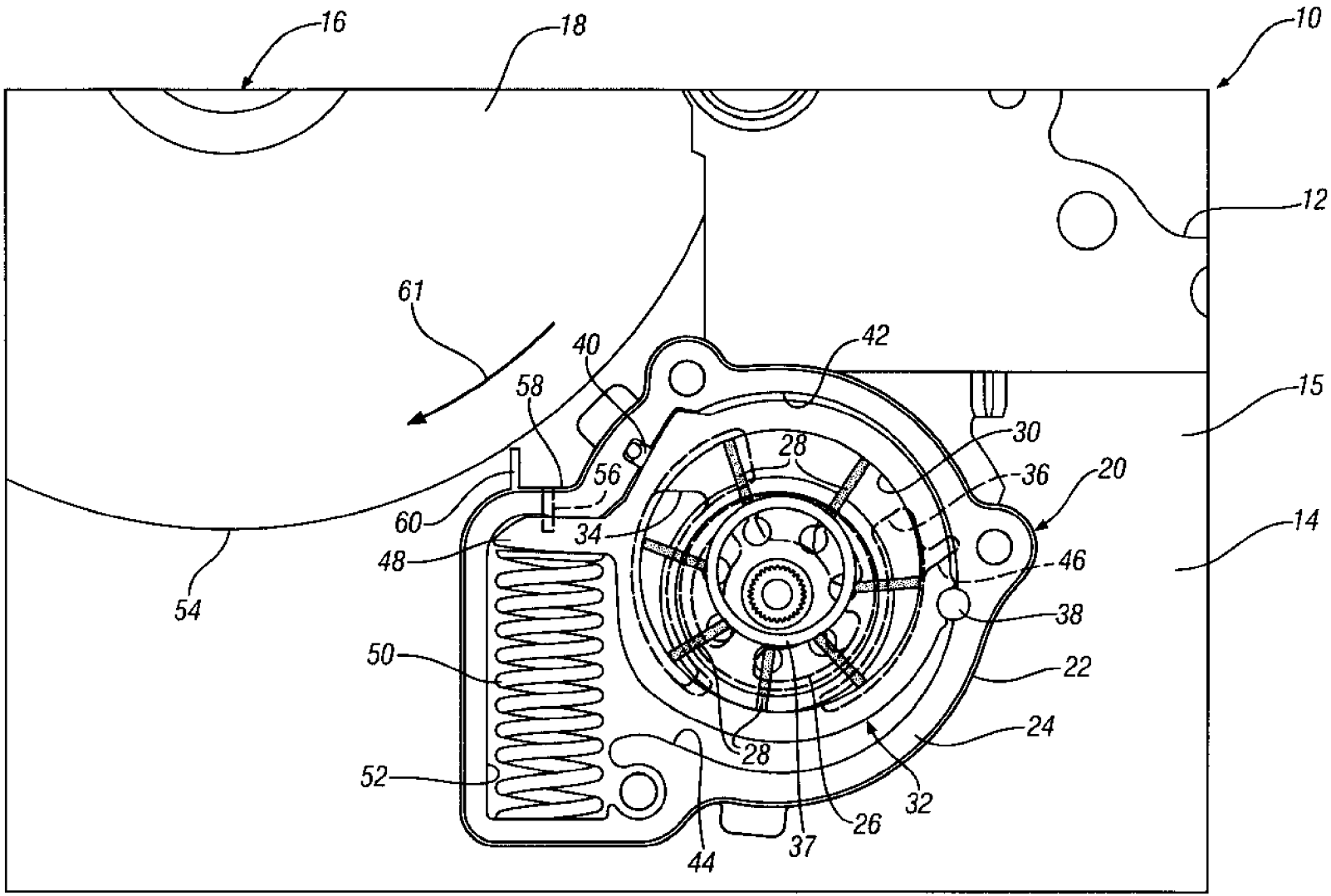
FIG. 1 is an end view of a portion of an engine crankcase mounting a variable displacement oil pump shown in cross section with a cam ring in a maximum displacement position.
Figure 2:
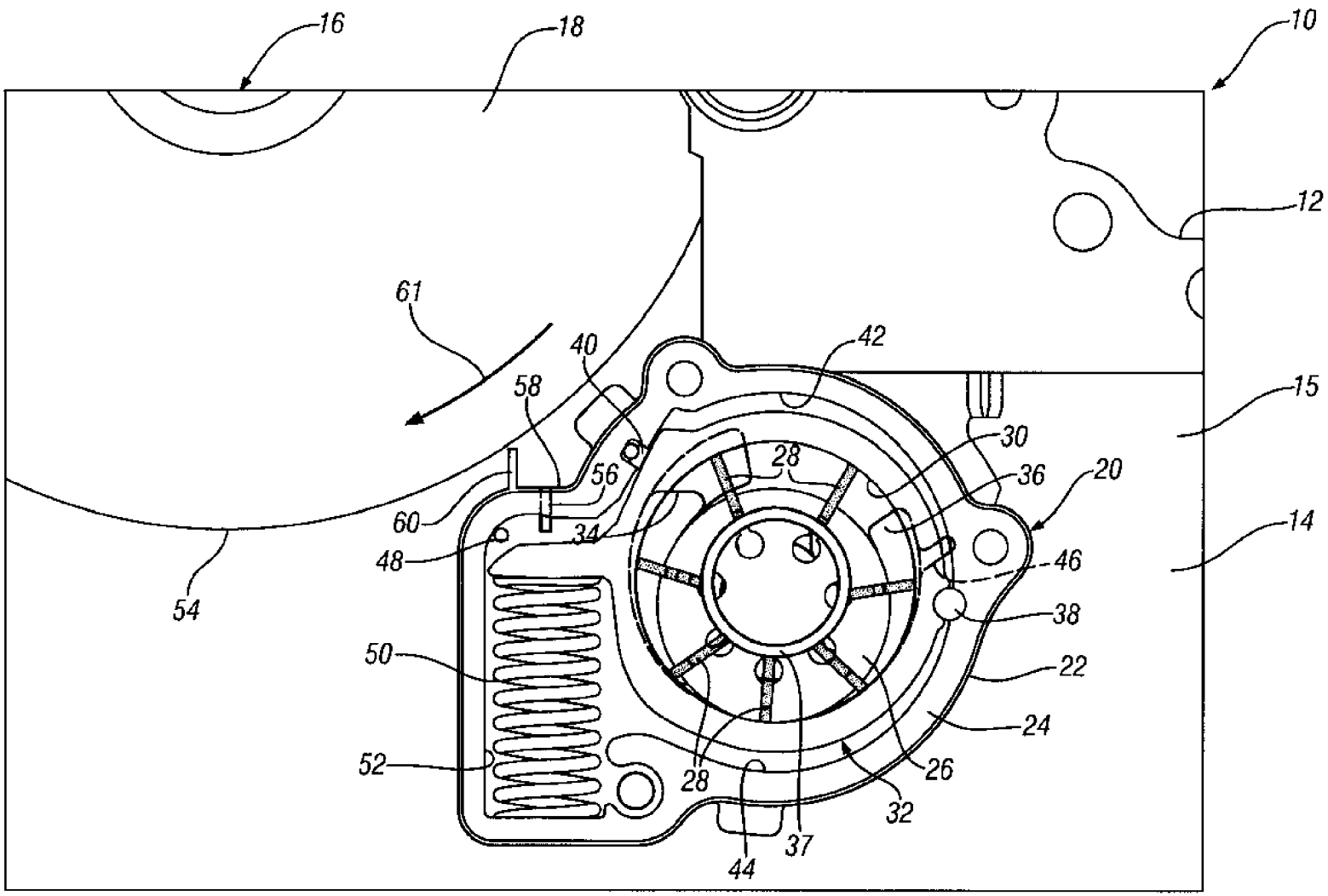
FIG. 2 is a similar view of the engine crankcase and the oil pump with the cam ring shown in a reduced displacement position.

Referring now to FIGS. 1 and 2 of the drawings in detail, numeral 10 generally indicates an internal combustion engine of a type suitable for use in automotive vehicles but representative of other engine applications. The figures illustrate an interior end view in an engine crankcase 12, including a portion of an oil pan 14 mounted below the crankcase and forming a sump containing oil for lubrication of the moving parts of the engine. Together, the crankcase 12 and the oil pan 14 define an enclosed mechanism compartment 15 in which a crankshaft 16, supported by the crankcase, and possibly other major components, such as balance shafts, comprise members rotatable at engine speed or at a rotational speed related to engine speed. Conventionally, the crankshaft includes crank throws connected with connecting rods, not shown, and counterweights 18, one of which is shown.

Also present in the crankcase 12, or mechanism compartment 15, is an engine oil pump 20 of a variable displacement vane type. The pump is shown with the drive cover removed to show the interior of the housing 22 defined within an outer wall 24 of the housing.

Within the housing is a rotor 26 having slots in which slidable vanes 28 are carried. The rotor is eccentric to the inner surface 30 of a cam ring 32 against which the vanes 28 slide to pump oil between an inlet port 34 and a pressurized outlet port 36. A guide ring 37, centered within the cam ring 32, guides the vanes outward to slide against the cam ring. The cam ring is pivotally connected to the inside of the outer wall 24 by a pivot 38 that allows oscillating motion of the cam ring within the housing. A seal 40 carried in the housing wall generally opposite to the pivot 38 separates the clearance surrounding the cam ring into a control chamber 42 and a vent chamber 44.

The control chamber 42 extends in the direction of pump rotation clockwise from the seal 40 to the pivot 38. An internal control orifice 46 connects the outlet port 36 and the control chamber 42 to supply outlet oil pressure to the control chamber.

The vent chamber 44 extends in the direction of pump rotation clockwise from the pivot 38 to the seal 40. Within the vent chamber, a tang 48 extends from the cam ring generally opposite from the pivot. The tang engages a biasing spring 50 extending within a spring chamber 52, forming part of the vent chamber 44, to the outer wall 24 of the housing 22 and urging the cam ring 32 in a direction to minimize the volume of the control chamber 42 and maximize the displacement of the pump 20 as is shown in FIG. 1 of the drawings. In operation, pump oil pressure in the control chamber opposes the spring force and acts to limit the maximum pump pressure by pivoting the cam ring 32 in a direction to reduce the volume of the vent chamber and minimize the displacement of the pump as is shown in FIG. 2.

In accordance with the invention, the oil pump is mounted to the crankcase 12 with a portion of the outer wall 24, defining the spring chamber 52 and the vent chamber 44, located near the outer periphery 54 of a crankshaft counterweight 18 and forming a rotatable surface of the counterweight. The vent chamber is connected by a vent 56 through the outer wall 24 and facing toward the rotatable surface of the counterweight periphery 54 from a pocket 58 in the outer wall. A raised fin 60 on the outer wall extends close to the periphery 54 beyond the vent 56 in the direction of rotation of the crankshaft counterweight 18.

In operation, clockwise rotation of the crankshaft 16 and the counterweight 18 in the direction of the arrow 61, as shown in FIG. 2, creates a rotating body of fluid surrounding the crankshaft, including the periphery 54 of the counterweight. The fin 60 blocks some of the flow of air and entrained oil droplets and converts the momentum of the blocked fluid to a static fluid pressure. The static pressure passes through the vent and pressurizes the vent chamber with a pressure varying as a function of engine speed. The pressure in the vent chamber acts against the force of the oil pressure in the control chamber, thereby partially offsetting the speed limiting force of the control chamber pressure on the cam ring and causing an increase in the pump outlet pressure in accordance with the effect of the increase in the engine speed.

Figure 3:
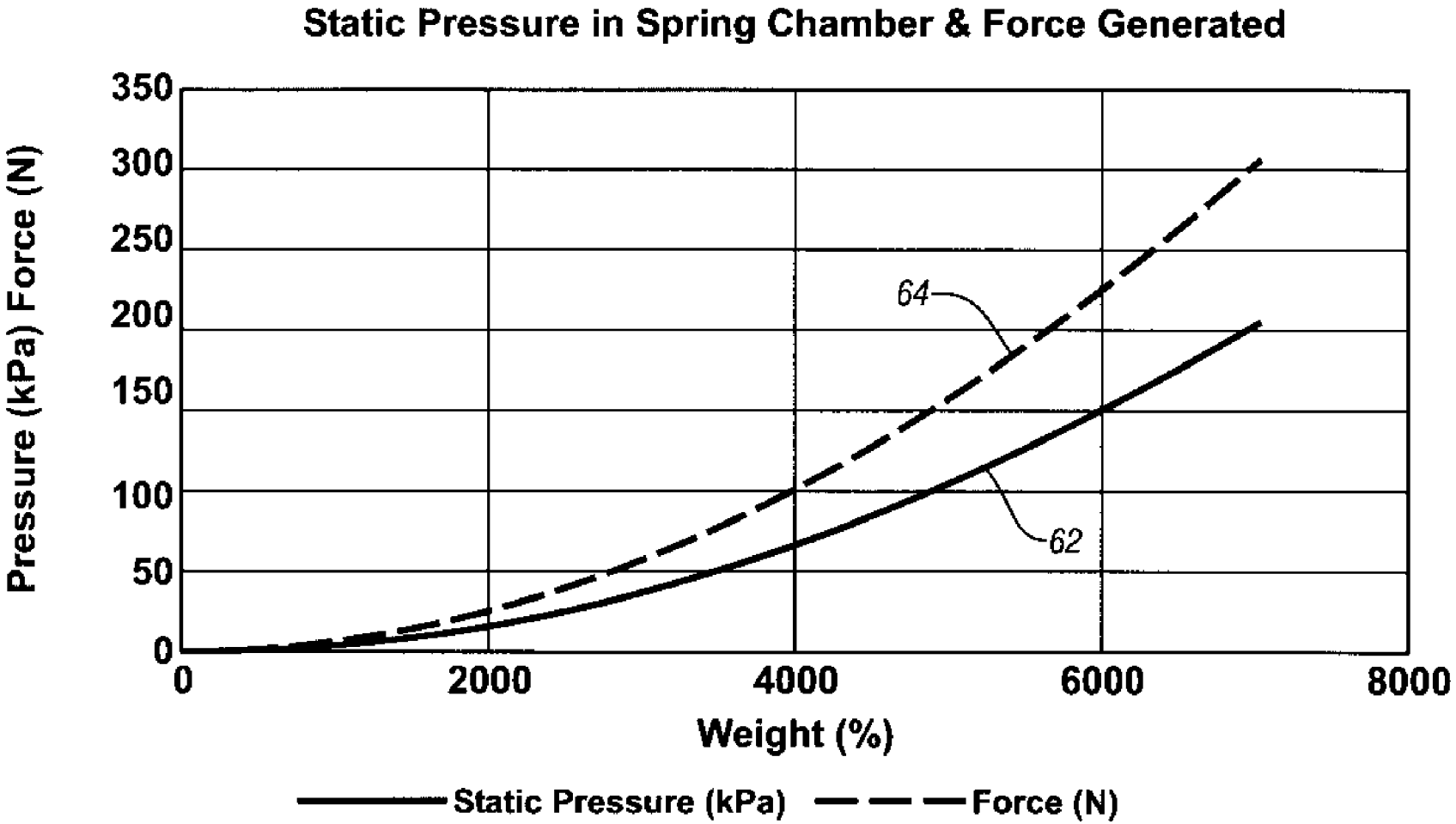
FIG. 3 is a graph of static fluid pressure and force developed vs. engine speed in a selected embodiment of the invention.

As an example, FIG. 3 is a graph showing the calculated results assuming air mixed with 10 percent oil rotating with an engine counterweight at various engine speeds as shown in the figure. The static pressure developed from the momentum of the fluid, indicated by the solid line 62, ranges from zero to 200 kPa while the force developed against the cam ring, indicated by the dashed line 64, increases to over 300 N at 7000 engine rpm. Thus, a substantial increase in oil pressure at higher engine speeds may be realized by suitable sizing of the surfaces of the cam ring exposed to pressures in the control chamber and the vent chamber to match the desired results for a range of operating conditions while limiting changes to the engine and oil pump to relatively simple modifications. The extent of the force developed will be dependent on the pump geometry and engine operating conditions, such as speed and temperature.

Various other rotatable engine and related components might be mentioned that could be used for developing usable pressures from the momentum of fluids such as air, oil, or mixtures carried along their rotating surfaces. Examples include camshafts, balance shafts, drive gears, chains, belts, transmission gears, flywheels and the like.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. An internal combustion engine including a mechanism compartment containing a rotatable member operable at a rotational speed related to engine speed, the member in operation creating fluid flow along a rotatable surface of the member;

a variable displacement engine oil vane pump driven by the engine and associated with the mechanism compartment, the pump including:

pumping chambers defined by slide vanes carried by a rotor rotatable in a housing for pumping engine oil from an inlet to a pressurized outlet;

a displacement control for controlling displacement of the pumping chambers, the displacement control including:

a cam ring in the housing pivotally connected to a wall of the housing by a pivot, the cam ring being internally engaged by the vanes;

a control chamber defined by the cam ring and the housing wall;

a control orifice for communicating control oil to the control chamber and operative to urge the cam ring in a direction to limit pump oil outlet flow as oil outlet pressure increases;

a vent chamber generally opposite the control chamber and defined by the cam ring and the housing wall;

a vent opening through the housing wall and communicating the vent chamber with the fluid flow along the rotatable surface; and means blocking the fluid flow beyond the vent opening and converting the momentum of the fluid flow into a static fluid pressure within the vent chamber that urges the cam ring in an oil flow increasing direction and thereby increases the pump outlet oil flow as the engine speed increases.

2. An engine as in claim 1 wherein the displacement control includes a resilient biasing member urging the cam ring in a direction to increase pump oil outlet flow, oil pressure in the control chamber acting against the force of the biasing member.

3. An engine as in claim 2 wherein the biasing member is a spring disposed within a spring chamber that is open to the vent chamber so that fluid pressure in the vent chamber supplements the spring force in increasing the pump oil outlet flow.

4. An engine as in claim 1 wherein the oil pump is mounted within the mechanism compartment adjacent to the rotatable member.

5. An engine as in claim 4 wherein the means blocking the fluid flow beyond the vent opening is a protrusion from the pump housing extending adjacent to the rotatable surface of the member and directing the fluid pressure into the vent opening.

6. An engine as in claim 5 wherein the control chamber and the vent chamber are separated in the pump housing by a seal engaging the pump housing and the cam ring between the control and vent chambers.

7. An engine as in claim 1 wherein the mechanism compartment is within a crankcase and the rotatable member is a crankshaft.

8. An engine as in claim 7 wherein the rotatable surface is on a counterweight of the crankshaft.

9. An engine as in claim 8 wherein the rotatable surface is on an outer periphery of the counterweight.

10. An engine as in claim 7 wherein the mechanism compartment is partially within an oil pan mounted on the crankcase.

11. An engine as in claim 1 wherein the oil pump is mounted on the crankcase and extends within the oil pan.

12. An engine as in claim 3 wherein the vent opening connects the vent chamber with a pocket for static fluid pressure adjacent to the rotatable surface.

13. An internal combustion engine including a mechanism compartment containing a rotatable member operable at a rotational speed related to engine speed, the member in operation creating fluid flow along a rotatable surface of the member;

flow blocking means adjacent to the rotatable surface and forming a pocket wherein fluid flow along the rotatable surface is blocked to develop static fluid pressure in the pocket varying as a function of engine speed;

a variable displacement engine oil vane pump driven by the engine and mounted in the mechanism compartment, the pump including:

a housing enclosing a cam ring pivotable on a wall of the housing for movement between maximum and minimum pump oil flow displacement positions;

a spring urging the cam ring toward the maximum displacement position for providing maximum oil flow upon startup;

a control chamber between the cam ring and the housing wall and connected to outlet oil pressure of the pump urging the cam ring toward the minimum displacement position against the force of the spring to limit the maximum pump outlet oil pressure; and a vent chamber between the cam ring and the housing wall generally opposite the control chamber, the vent chamber connected to receive from the pocket static fluid pressure urging the cam ring toward the maximum displacement position to increase the controlled pump outlet oil pressure as a function of engine speed.

* * * * *